US005232552A

United States Patent [19]

Lundberg et al.

[11] Patent Number: 5,232,552

[45] Date of Patent: Aug. 3, 1993

[54] SCREENING DEVICE

[75] Inventors: N. Jörgen Lundberg, Sundsvall; Alf I. Lindström, Sundsbruk, both of Sweden

[73] Assignee: Sunds Defibrator Industries Aktiebolag, Sweden

[21] Appl. No.: 671,792

[22] PCT Filed: Oct. 16, 1989

[86] PCT No.: PCT/SE89/00568

§ 371 Date: Mar. 21, 1991

§ 102(e) Date: Mar. 21, 1991

[87] PCT Pub. No.: WO90/05807

PCT Pub. Date: May 31, 1990

[30] Foreign Application Priority Data

Nov. 17, 1988 [SE] Sweden ..... 8804161

[51] Int. Cl.[5] ..... D21G 9/08; B07B 1/20

[52] U.S. Cl. ..... 162/55; 210/415; 209/273

[58] Field of Search ..... 162/55, 308; 210/413, 210/415; 209/273, 306, 380, 255, 258, 270

[56] References Cited

U.S. PATENT DOCUMENTS

| | | | |
|---|---|---|---|
| 3,953,325 | 4/1976 | Nelson | 209/273 |
| 3,964,996 | 6/1976 | Holz | 209/273 |
| 3,970,548 | 7/1976 | Seifert | 209/273 |
| 4,200,537 | 4/1980 | Lamort | 209/273 |
| 4,202,761 | 5/1980 | Holz | 209/273 |
| 4,328,096 | 5/1982 | Chupka et al. | 209/273 |
| 4,351,728 | 9/1982 | Egelhof et al. | 209/273 |
| 4,447,320 | 5/1984 | Lamort | 209/273 |
| 4,744,894 | 5/1988 | Gauld | 209/273 |
| 4,836,915 | 6/1989 | Frejborg | 209/273 |
| 4,911,828 | 3/1990 | Musselmann | 209/273 |
| 4,919,797 | 4/1990 | Chupka | 209/273 |
| 5,000,842 | 3/1991 | Ljokkoi | 209/306 |

FOREIGN PATENT DOCUMENTS

| | | | |
|---|---|---|---|
| 275921 | 1/1988 | European Pat. Off. . | |
| 206975 | 4/1990 | European Pat. Off. . | |
| 1437422 | 5/1976 | United Kingdom | 210/415 |

*Primary Examiner*—W. Gary Jones
*Assistant Examiner*—Brenda Lamb
*Attorney, Agent, or Firm*—Lerner, David, Littenberg, Krumholz & Mentlik

[57] ABSTRACT

Devices for screening pulp suspensions are disclosed including a cylindrical screen extending longitudinally within a housing, an inlet for feeding the pulp suspension into the interior of the cylindrical screen, an accept outlet for removing the accept portion of the pulp suspension after it has passed through the cylindrical screen, a reject outlet for removing a reject portion of the pulp suspension at the opposite end of the cylindrical screen with respect to the inlet, and a rotor concentrically positioned for rotation within the cylindrical screen such that an annular screen chamber is created between the rotor and the screen, the rotor including wings extending from its exterior such that the wings have a length circumferentially with respect to the rotor which ranges from about 2:1 to about 6:1 with respect to the distance between the rotor and the screen, and the leading edges of the wings being separated a greater distance from the rotor than the trailing edges of the wings.

10 Claims, 1 Drawing Sheet

SCREENING DEVICE

FIELD OF THE INVENTION

The present invention relates to devices for screening pulp suspensions. More particularly, the present invention relates to devices for screening pulp suspensions for the purpose of separating impurities and other pulp fractions which are unsuitable for the final desired product, such as coarse particles, undefibered material, and poorly processed fibers.

BACKGROUND OF THE INVENTION

During the screening of pulp suspensions, high pulp concentrations, for example, from 3 to 5%, are desired in order to achieve high production capacity and to avoid the transporting of unnecessarily high liquid volumes through the screening system. The use of high concentrations, however, creates considerable difficulty in then separating the undesirable fractions from the pulp. That is, the apertures in the screen plate being utilized can easily become clogged, and it becomes difficult to selectively separate the impurities at low reject withdrawal rates. These difficulties are primarily a result of the thickening of the reject portion, which itself takes place because the liquid preferentially follows along with the accept fraction through the screen plate. This problem is avoided in conventional screens by the reject portion being diluted by the addition of further liquid. This is undesirable, however, for the reasons set forth above.

Various screen designs have thus been developed in an attempt to solve these problems. One example of such a screen design is the arrangement of wing sections on a rotary member, which is to be moved along the screen member in order to bring about instantaneous cleaning pulses, and to thus prevent the clogging of the screen apertures. Such a design is shown, for example, in U.S. Pat. No. 4,328,096. The problem of reject thickening, however, is not solved by such a device, which is also still not applicable to high pulp concentrations.

In European Patent Application No. 206,975, for example, another screening device is shown, in this case comprising a screening cylinder and an inner rotor, which is provided with members which are intended to bring about pulsations in the pulp suspension. These members have a cross leading edge, and a curved surface therebehind, the distance of which from the screening cylinder increases successively. The leading edge thus produces a positive pressure pulse, and the curved surface produces a negative pressure pulse, in order to thereby bring about a separation of impurities over the screen plate. By using this design, however, there is a risk that the pulp will be transported about by the cross leading edge to too great an extent, thus decreasing the relative speed between the rotor and the pulp, until the suction pulse ceases and the screening process is terminated. The screen thus becomes blind, this effect decreases, and the accept flow itself ceases. Moreover, the cross leading edge yields a short, strong pressure pulse, which has a negative effect on the cleaning process. A similar design is shown in U.S. Pat. No. 4,200,537. According to the device shown in this patent, the rotor can be arranged to rotate in different directions. The embodiment shown in FIG. 3 of this patent corresponds to the aforesaid European patent publication, and has the aforementioned disadvantages. The embodiment shown in FIG. 2 therefore provides a sloping leading surface, and a cross trailing edge of the pulsation members. This gives rise to problems with the thickening of the reject, again in the manner stated above.

SUMMARY OF THE INVENTION

In accordance with the present invention, these and other problems have now been solved by the invention of a device for screening pulp, which is designed to now render it possible to screen the pulp effectively at high concentrations, including high accept and reject concentrations. Furthermore, the effective consumption of this device is relatively low.

In accordance with the present invention, a device for screening pulp suspensions is provided which includes a housing, a cylindrical screen having an interior and an exterior, and extending longitudinally within the housing, the cylindrical screen having a first end and a second end, inlet means for feeding the pulp suspension into the interior of the cylindrical screen at the first end of the cylindrical screen, an accept outlet for moving an accept portion of the pulp suspension from the housing after the accept portion has passed through the cylindrical screen, a reject outlet for removing a reject portion of the pulp suspension from the housing at the second end of the cylindrical screen, and rotor means concentrically located within the interior of the cylindrical screen and adapted to rotate therein in a predetermined direction so as to create an annular screening chamber having a predetermined radial dimension between the rotor means and the cylindrical screen, the rotor means including a plurality of wing members extending from its exterior and including a leading edge and a trailing edge with respect to the predetermined direction of rotation of the rotor means, the plurality of wing members having a circumferential length which ranges from about 2:1 to about 6:1 with respect to the predetermined radial dimension, and having a shape such that the distance between the leading edges of the plurality of wing members and the exterior of the rotor means is greater than the distance between the trailing edges of the plurality of wing members and the exterior of the rotor means. Preferably, the rotor means is free of perforations.

In accordance with one embodiment of the device of the present invention, the plurality of wing members extends longitudinally along the exterior of the rotor means for a predetermined distance, and preferably this predetermined distance is substantially the entire longitudinal length of the rotor means.

In accordance with another embodiment of the device of the present invention, the distance between the plurality of wing members and the exterior of the rotor means decreases continuously from the leading edges of the wing members to the trailing edges of the wing members.

In accordance with another embodiment of the device of the present invention, the plurality of wing members comprises a first plurality of wing members, and the device includes a second plurality of wing members displaced longitudinally along the rotor means with respect to the first plurality of wing members, and the device includes partition means between the first and second pluralities of wing members, the partition means including recess means for permitting passage of the pulp suspension therethrough.

In accordance with another embodiment of the device of the present invention, the leading edges of the plurality of wing members and the trailing edges of the plurality of wing members extend substantially longitudinally along the exterior of the rotor means.

In another embodiment, however, the leading edges of the plurality of wing members and the trailing edges of the plurality of wing members extend at an angle with respect to the longitudinal direction of the rotor means.

In accordance with a preferred embodiment of the device of the present invention, the device includes barrier means extending radially from the exterior of the rotor means at the second end of the cylindrical screen, and the partition means includes recess means whereby the flow of the reject portion of the pulp suspension is substantially restricted therethrough.

In a preferred embodiment, the recess means comprises a plurality of recesses corresponding to the plurality of wing members, the plurality of recesses being located adjacent to the trailing edges of the corresponding plurality of wing members.

BRIEF DESCRIPTION OF THE DRAWINGS

This invention may be more fully understood with reference to the following detailed description, which, in turn, refers to the accompanying drawings, in which.

DETAILED DESCRIPTION

Figure 1:
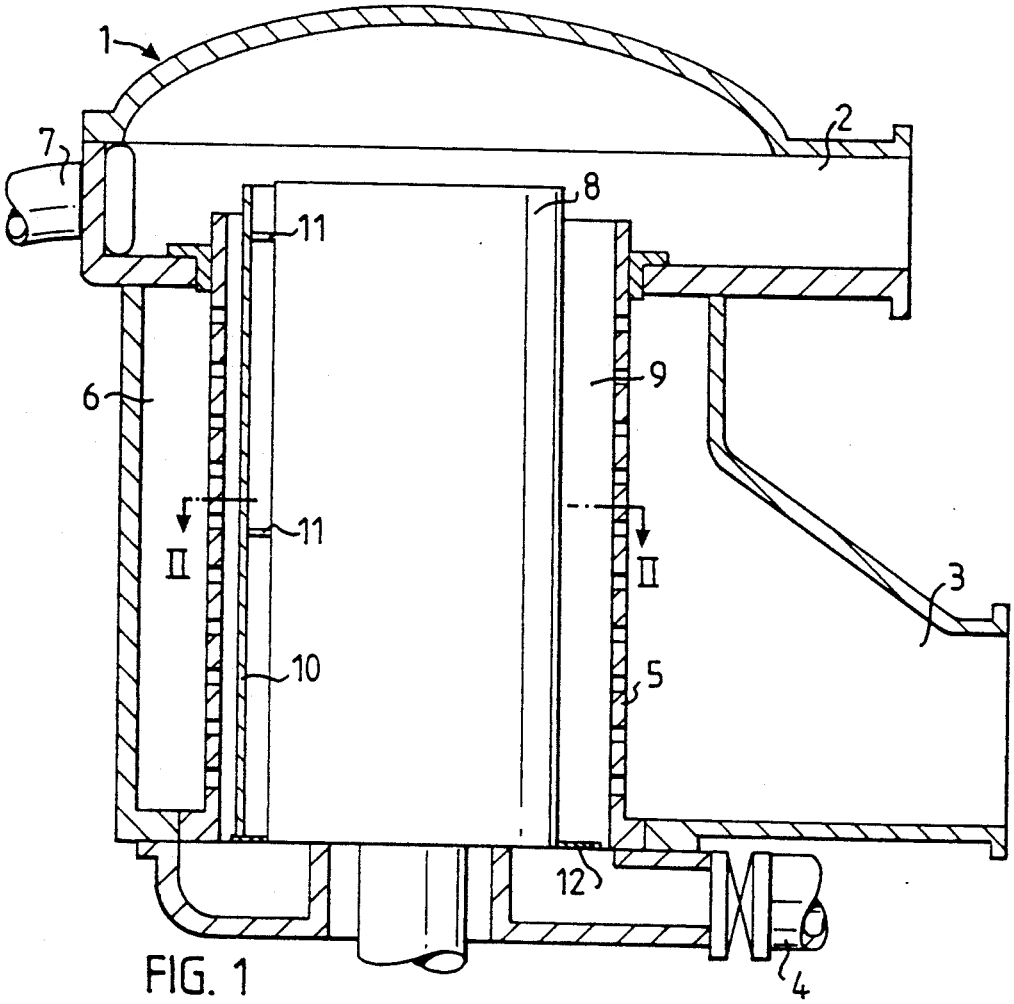
FIG. 1 is a side, elevational, sectional view of a screening device in accordance with the present invention.
Figure 2:
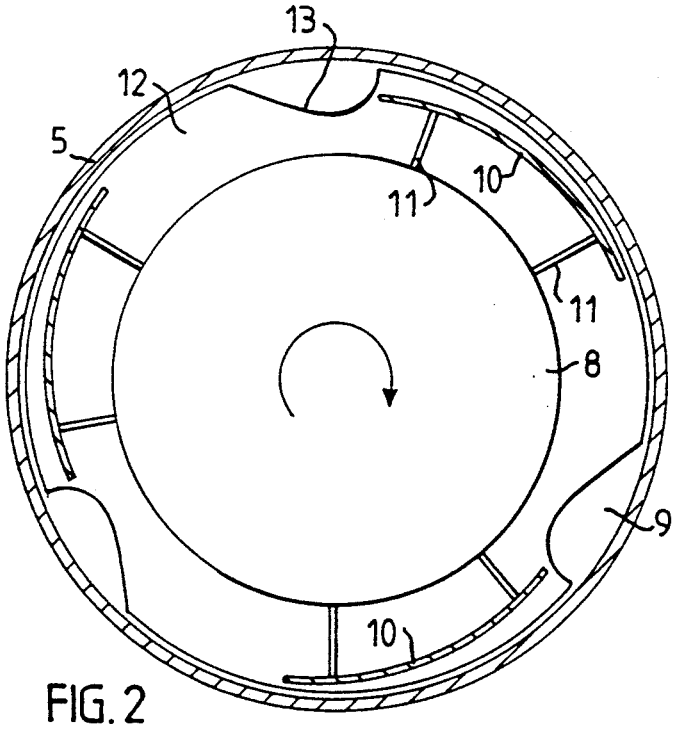
FIG. 2 is a top, elevational, sectional view of the screen device shown in FIG. 1 taken along section II—II thereof.

Referring to the Figures, in which like numerals refer to like portions thereof, the screening device of the present invention includes an air-tight casing 1 with an inlet 2 for the pulp suspension, and outlets 3 and 4 for the accept and reject portions, respectively. In the casing there is located a cylindrical screening member 5, preferably with a vertical axis of symmetry. The pulp inlet 2 communicates with the interior of the screening member 5 at the upper end of the housing, while the reject outlet 4 communicates with the lower end of the screening member 5. The accept outlet 3 is connected to an annular space 6, which extends about the screening member 5. In the upper portion of the casing 1 there is located an outlet 7 for coarse reject (scrap).

Within the screening member 5 there is located an unperforated cylindrical rotor 8, which preferably extends along the entire screening member 5. The rotor 8 is concentric to the screening member 5, so that a screen chamber 9 is formed extending annularly between the rotor 8 and the screening member 5. The rotor 8 may alternatively be designed to be slightly conical, the greatest diameter being closest to the reject outlet 4.

The rotor 8 is provided with at least two wing elements 10, which are secured onto the rotor 8 by means of support members, so that they are located in the screen chamber 9 spaced from both the rotor 8 and the screening member 5. The wing elements 10 are placed at a spaced relationship to each other, and they extend axially along the longitudinal length of the rotor 8. The length of these wing elements 10 as seen in the circumferential direction yields a relationship between this length and the radial dimension of the screen chamber 9 of between about 2:1 to 6:1. With a rotor diameter of about 1 m, the length of the wing elements in the circumferential direction can be, for example from about 300 to 600 mm. The mutual distance between the wing elements can then be from about 150 to 400 mm. Furthermore, the wing elements 10 are preferably placed such that their leading edges, as seen in the direction of rotation of the rotor 8, are located at a greater radial distance from the axis of the rotor 8 than are their trailing edges, which distance preferably decreases continuously therebetween. The distance between the leading edge and the screening member 5 should preferably be from about 5 to 40 mm.

The wing elements 10 can preferably extend axially along the entire longitudinal length of the rotor 8, or in axially defined zones. These zones are preferably defined by partition walls extending entirely around the rotor 8, and include recesses which allow the axial passage of the pulp. The wing elements 10 in these different zones are also offset with respect to each other as seen in the circumferential direction. The wing elements 10 can also be designed so as to have axially straight leading and trailing edges, or axially oblique leading and trailing edges.

The rotor 8 will preferably also be provided with a bottom ring 12, which is located at the lower end on the rotor in order to shield the reject outlet 4 so as to prevent any short circuits between the inject and reject side. The bottom ring 12 thus defines the area which is accessible to the reject flow by being formed as a wall with recesses 13. These recesses 13 should be located adjacent to the trailing edges of the wing elements 10 which are located closest thereto. Furthermore, recesses 13 can be formed so as to prevent oblong impurities from adhering to the edges of the recesses, i.e., the trailing edges of the recesses must thus incline rearwardly with respect to the direction of the rotor 8.

In actual operation, the pulp suspension is supplied through inlet 2 to the screen chamber 9. In the screen chamber 9, the pulp suspension moves axially to the reject outlet 4, while the rotor 8 with the wing elements 10 simultaneously causes the pulp to rotate. The accept is thus caused to pass through the apertures in the screening member 5. Due to the form of the wing elements 10, a relatively long suction pulse affects the screening member 5 when the wing element 10 moves along the surface of the screening member 5. this, in turn, causes a portion of the liquid which has passed out through the apertures in the screening member to be sucked back into the screen chamber 9. In this manner, thickening of the reject is counteracted, i.e., it is now possible, without the need to supply diluting liquid, to nevertheless limit the concentration in the reject portion.

Due to the fact that this device permits the pulp suspension to also flow beneath the wing elements 10, a favorable activation of the suspension is obtained. That is, at the same time that the space between the wing elements 10 and the screening member 5 increases along the wing elements 10, the distance between the wing elements 10 and the rotor 8 decreases. In this manner, pressure and speed variations which are favorable to screening are produced in the pulp suspension, and these, in turn, promote separation of the pulp suspension into accept and reject portions.

By dividing the wing elements 10 into several axially defined zones, these pressure and suction pulses can be distributed over the screening member, so that any strains on the screening member can be reduced. This can be most useful in connection with screening devices having large dimensions.

The object of placing the wing elements 10 at an incline with respect to the longitudinal direction is to reduce the risk of impurities adhering to the leading edge. This risk, however, has not proved to be so great as to render it necessary to form the wing elements in this manner.

The object of the bottom ring 12 is to prevent short circuiting between the inject inlet 2 and the reject outlet 4, i.e., to prevent partially untreated pulp suspension from passing through the screen chamber 9. The location of the recesses 13 is chosen so that they are in the position where the reject is at maximum concentration, which should be immediately after the location of the suction pulses produced by the wing elements 10.

The screening member 5 should be formed with a screen plate, which has unevennesses, such as grooves, located on the inside in order to facilitate the separation of the accept. This is particularly advantageous in the case of high pulp concentrations.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A device for screening pulp suspensions comprising a housing, a cylindrical screen having an interior and an exterior and extending longitudinally within said housing, said cylindrical screen having a first end and a second end, inlet means for feeding said pulp suspension into said interior of said cylindrical screen at said first end of said cylindrical screen, an accept outlet for removing an accept portion of said pulp suspension from said housing after said accept portion has passed through said cylindrical screen, a reject outlet for removing a reject portion of said pulp suspension from said housing at said second end of said cylindrical screen, and rotor means concentrically located within said interior of said cylindrical screen, said rotor means being free of perforations and structured and arranged to rotate therein in a predetermined direction so as to create an annular screening chamber having a predetermined radial dimension between said rotor means and said cylindrical screen, said rotor means including a plurality of wing members mounted in spaced relationship to said exterior of said rotor means whereby said pulp suspension can flow in said space between said wing members and said rotor means in a direction substantially transverse to the axis of said rotor means and opposite to the direction of rotation thereof, said wing members including a leading edge and a trailing edge with respect to said predetermined direction of rotation of said rotor means said plurality of wing members having a circumferential length which ranges from about 2:1 to about 6:1 with respect to said predetermined radial dimension, and having a shape such that along the length of said plurality of wing members from said leading edge to said trailing edge the distance between said plurality of wing members to said exterior of said rotor means decreases while the distance between said plurality of wing members to said cylindrical screen increases, whereby a relatively long suction pulse is created with respect to said cylindrical screen thereby drawing liquid back through said cylindrical screen into said annular screening chamber and said pulp suspension between said plurality of wing members and said rotor means is activated thereby.

2. The device of claim 1 wherein said plurality of wing members extend longitudinally along said exterior of said rotor means for a predetermined distance.

3. The device of claim 2 wherein said predetermined distance comprises substantially the entire longitudinal length of said rotor means.

4. The device of claim 1 wherein said distance between said plurality of wing members and said exterior of said rotor means decreases continuously from said leading edges of said wing members to said trailing edges of said wing members.

5. The device of claim 1 wherein said leading edges of said plurality of wing members and said trailing edges of said plurality of wing members extend substantially longitudinally along said exterior of said rotor means.

6. The device of claim 1 wherein said leading edges of said plurality of wing members and said trailing edges of said plurality of wing members extend at an angle with respect to said longitudinal direction of said rotor means.

7. The device of claim 1 wherein said circumferential length of said plurality of wing members is between about 300 and 600 mm.

8. The device of claim 7 wherein said plurality of wing members are separated circumferentially from each other by a distance of between about 150 and 400 mm.

9. The device of claim 1 including barrier means extending radially from said exterior of said rotor means at said second end of said cylindrical screen, said barrier means including recess means whereby the flow of said reject portion of said pulp suspension is substantially restricted therethrough.

10. The device of claim 9 wherein said recess means comprises a plurality of recesses corresponding to said plurality of wing members, said plurality of recesses being located adjacent to said trailing edges of said corresponding plurality of wing members.

* * * * *

UNITED STATES PATENT AND TRADEMARK OFFICE

CERTIFICATE OF CORRECTION

PATENT NO. : 5,232,552

DATED : August 3, 1993

INVENTOR(S) : Lundberg et al.

It is certified that error appears in the above-indentified patent and that said Letters Patent is hereby corrected as shown below:

Column 3, line 39, after "casing", insert --1--.
Column 3, line 58, after "members", insert --11--.

Signed and Sealed this

Twenty-ninth Day of March, 1994

*Attest:*

*Attesting Officer*

BRUCE LEHMAN

*Commissioner of Patents and Trademarks*